United States Patent [19]

Nelson

[11] Patent Number: 5,016,891

[45] Date of Patent: May 21, 1991

[54] PROJECTILE-TARGET GAME APPARATUS

[76] Inventor: Donald E. Nelson, 301 Newark Rd., Mt. Vernon, Ohio 43050

[21] Appl. No.: 477,029

[22] Filed: Feb. 8, 1990

[51] Int. Cl.[5] ..... A63B 67/00

[52] U.S. Cl. ..... 273/407; 273/317; 273/348; 273/417

[58] Field of Search ..... 273/398, 399, 407, 416, 273/417, 67 R, 348, 317

[56] References Cited

U.S. PATENT DOCUMENTS

| | | | |
|---|---|---|---|
| 2,744,752 | 5/1956 | Arnold | 273/398 |
| 3,507,494 | 8/1970 | Finkel | 273/67 R |
| 3,628,793 | 10/1971 | Mudloff | 273/415 X |
| 3,749,402 | 11/1973 | Adickes et al. | 273/415 |
| 4,186,925 | 7/1980 | Goldfarb et al. | 273/389 |
| 4,262,909 | 9/1981 | Becker et al. | 273/323 |
| 4,726,591 | 6/1988 | Johnson | 273/339 |

FOREIGN PATENT DOCUMENTS

| | | | |
|---|---|---|---|
| 279329 | 3/1952 | Switzerland | 273/399 |

*Primary Examiner*—William H. Grieb

[57] ABSTRACT

A game target useable with a palm held projectile tossed at a target. The projectiles being light weight provide safe use by almost all ages. Also, younger players can be skilled enough to compete with adults. The target is mounted to tube sections which are loosely spaced on a circular formed tube but snug enough to hold position until the projectile lands. This fit in addition to the generally shaped frustum projectile and an inclined target provide the means for the target to capture the projectile landing squarely on the target landing surface. The game apparatus can be used for various games or scoring methods such as horseshoe type scoring, a horse method similar to the basketball game of Horse, use for a hole in one contest or layout of several targets for a short course golf type scoring procedure. The apparatus also can provide exercise for those who prefer activity rather than routine calisthenics. The apparatus can be used indoors with some care and discretion.

7 Claims, 1 Drawing Sheet

PROJECTILE-TARGET GAME APPARATUS

FIELD OF INVENTION

The Present invention relates to games and amusement devices especially projectile objects aimed at a target.

DESCRIPTION OF PRIOR ART

Heretofore, games or sporting events such as horseshoe pitching or quoits required a target area which disfigured the normal grass and sod of a lawn or park area. This creates a major inconvenience where the game can be played. Lawn dart games solve the lawn damage problem by providing a simple plastic hoop like circular target. However, this target is difficult to see in seldom mowed grassy areas such as parks or camping sites.

Prior art also involved safety problems with projectiles such as horseshoes or pointed lawn darts. The latter has been responsible for serious injuries especially if played by children without adult supervision. Horseshoes as well can be dangerous and are too heavy for proper use by children. Thus, horseshoe pitching is not a family type sporting event.

Prior art uses projectiles that because of safety and weight objections cannot be used in areas as for example beach areas. My game invention solves these problems of lawn damage, safety and heavy projectiles.

Other targets for golf practice or golf lawn games are generally bulky, expensive or require assembly or set-up. Simple target inventions such as Reck, 4,171,134 (1979) and Florida, 4,358,116 (1982) still require set-up to move or must be left assembled on the lawn thereby killing the grass and creating obstacles to mow around. My invention is easily moved or stored, it is light weight and has no set-up necessary. My invention also provides a positive action in catching and then holding the projectile.

SUMMARY OF THE INVENTION

Accordingly I claim as my objects and advantages of the invention:

It is an object of my present invention, to provide an inexpensive, easy to use target for use with a variety of light weight projectiles. An additional object of my target invention is to eliminate lawn damage and special preparation of the lawn surface. Thus the target invention can be utilized in addition to home lawn areas, at parks, camping sites or beach areas as well as in garage or other indoor or roofed areas. The target remains visible in grassy areas which would obscure other targets and is easily transported for use away from home.

It is a still further object of my target invention, to provide an above ground target that "captures" the projectile in a similar sense that a golf hole captures a golf ball. Thus a sense of excitement is created from use of my target invention due to the unexpected result of holding the projectile when landed squarely on the target.

It is a further object of my invention to provide a target useable in combination with a variety of light weight projectiles. The object is to provide a safe projectile—target combination useable by children or adults and adapted for family use. Family sports is one way to help alleviate the long felt need of society to prevent family break up.

In addition it is an object of my invention to provide a modified badminton shuttlecock but slightly shorter and heavier than a standard shuttlecock for use in combination with my target invention.

The same advantages described above apply to games using the target invention with other projectiles such as a bean bag or light weight practice golf balls. Further, many scoring systems and combinations can be devised to provide a game method using the target and projectile combination. Game scoring can be adapted similar to horseshoe pitching or the familiar basketball game of Horse. In horseshoe type scoring, landing the projectile on the target would correspond to a ringer. In Horse one player leads off with a toss from any distance and any style toss i.e. backward shot, bounce shot, etc. If the shot is made then all other players must make the same shot or be penalized for a missed shot which is denoted as H. The second player leads off and other players follow in the same manner as the prior shot. A player assessed a H-0-R-S-E losses and is out of the game. The last player in the game wins.

BRIEF DESCRIPTION OF THE DRAWING FIGURES

DRAWING REFERENCE NUMERALS

Figure 1:
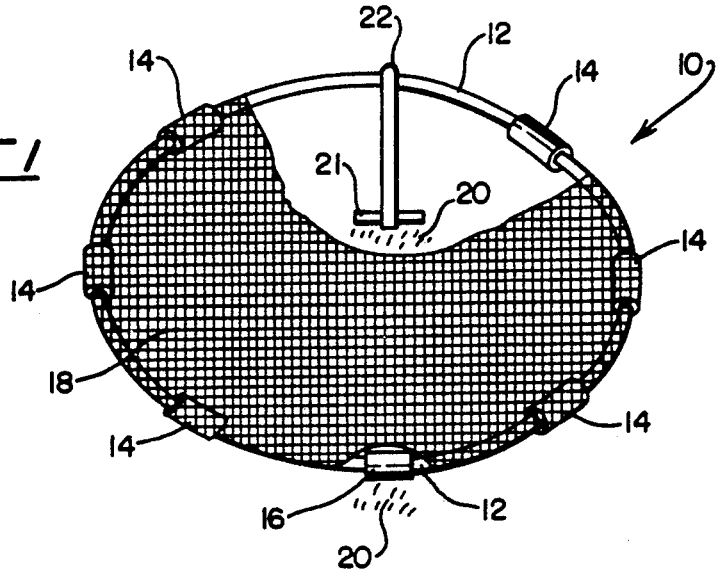
FIG. 1 is a perspective view of the target with a partial cut away of the mesh landing surface.

10 Game target
12 Circular formed tube
13 Dowel
14 Tube sections
16 Bottom tube section
18 Landing surface
20 Ground playing surface
21 Horizontal arm support
22 Pivot arm support
24 Palm held projectile
26 Skirt
28 Ribs
30 Nose
32 Washer
34 Ribs lower sections
35 Player
36 Trajectory path

DESCRIPTION OF THE PREFERRED EMBODIMENTS

Referring now to FIG. 1, a perspective view of a game target 10 is shown to be essentially circular in shape and is 13" in diameter. The diameter can vary plus or minus 4" depending on the degree of difficulty desired. The outer perimeter is defined by a circular formed tube 12 of approximately ⅜" outside diameter and ¼" inside diameter. The tube being a commonly available extruded plastic material such as polythylene or polypropylene. Circular formed tube 12 is formed and the tube ends secured by one of several common methods such as a dowel secured in the inside of each tube end, gluing or heat sealing the ends or securing the outside tube diameter inside of a sleeve.

Tube sections 14 are flexible tubing such as flexible poly vinyl chloride. A plurality of tube sections each approximately 4< in length provide a means to anchor a landing surface 18 and provide give to the projectile landing which enchances the capturing effect of game target 10. The sections for the 13" game target are approximately ½" inside diameter and have a 1/16" wall. Circular formed tube 12 is axially aligned to tube sections 14 thus the sections being incurvate on the circular formed tube 12. Tube sections 14 being straight in length when not assembled and incurvate when assembled on circular formed tube 12. Tube sections 14 when assembled on circular formed tube 12 are snug but rotatable. This fit provides a shock absorber effect when a projectile lands on landing surface 18.

A bottom tube section 16 is a rigid plastic tube and is positioned on the lower portion of circular formed tube 12. Bottom tube section 16 is approximately 2" long with a 1/16" wall. Landing surface 18 is held but not affixed to bottom tube section 16. Thus the lower portion, approximately 1½" of the landing surface is held in a pocket like fashion. This prevents the projectile landing on landing surface 18 from sliding off the game target. This feature is especially useful in areas of medium length grass.

Landing surface 18 is shown with a out away section to further illustrate the relationship of parts. Landing surface 18 is the target for the game projectile. Vinyl coated polyester mesh having a warp of 200 and a fill of 200 provides the properties required of the mesh fabric. These properties are resistance to ultraviolet degradation, rot and mildew. Said landing surface 18 as an alternative material can be thermo plastic sheeting having the above noted properties being perforate with a plurality of holes. Landing surface 18 is cut to fit the outside diameter of a circle scribed by tube sections 14. Said landing surface 18 is attached to tube sections 14 by adhesive. 3M vinyl adhesive 4475 was found to provide good adhesion. Tube sections while secured to the landing surface and positioned on circular formed tube 12 are rotatable by approximately 90 degrees. This is the give of landing surface 18 that enhances the capture effect of the game projectile.

Figure 2:
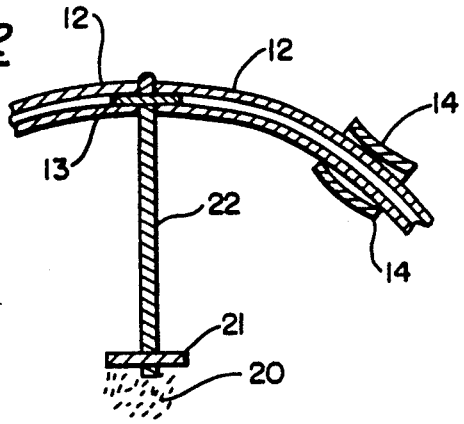
FIG. 2 is a cross section view of the joined ends forming the circular formed tube and the arm supports looking through the cut out of FIG. 1.

Referring now to FIG. 2 which shows the out away portion of the landing surface 18 and is a cross sectional view of the parts illustrated. The end of circular formed tube 12 are shown with a dowel snug fit in each end and also is positioned through a pivot arm support 22 with a loose enough fit to allow the support arm to pivot and support the upper portion of game target 10 approximately 6" off ground playing surface 20. Pivot arm support 22 swings to a position nearly parallel with landing surface 18 for moving or storage of game target 10. A horizontal arm support 21 is shown affixed to pivot arm support 22 lower end. This is shown as a rod approximately 4" in length and aids in preventing the game target from tipping when in use. FIG. 2 also depicts the snug fit of tube sections 14 on circular formed tube 12 resulting from being essentially straight tube sections fit over the curved tube. Interference occurs which then holds landing surface 18 taut yet allowing the landing surface to give by the rotation of tube sections 14 when a projectile is landed.

Figure 3:
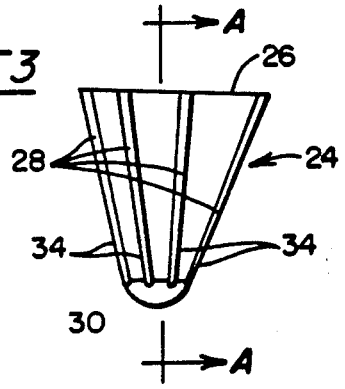
FIG. 3 is a side elevation of a projectile used in the game invention.

Referring now to FIG. 3, one type of palm held projectile 24 is shown in side elevation. The projectile is similar in shape to a badminton shuttlecock but is shorter and heavier. Skirt 26 is formed by molded plastic and a number of polymers may be utilized. A plurality of ribs are integral to the molded skirt and are used to stiffen the skirt. The lower portion of the ribs provide a housing for a nose 30.

Figure 4:
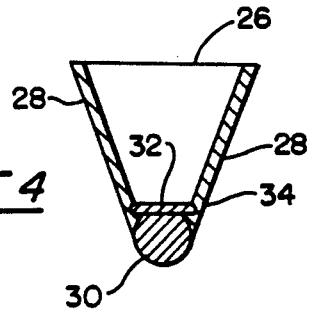
FIG. 4 is a sectional view taken on a line A—A' on FIG. 3.

FIG. 4 is a cross section of FIG. 3 along the line A—A'. This shows ball 30 being held by the lower portion of the ribs by extending below the center line of ball 30. A washer 32 holds nose 30 by a detent ring in the lower portion of the ribs being made of metal or rigid plastic. Nose 30 can be rubber such as EPDM or plastic having resilience to allow the desired bounce. This bounce is desirable to allow a score if the projectile first bounces on the ground and then lands on landing surface 18.

The desired weight of the projectile is ½ oz. to 1½ oz. The desired length is 1" to 3".

A standard badminton shuttlecock can be modified to provide the desired parameters. Ballast can be added by gluing a washer or washers inside the frustoconical skirt in similar location to the washer described above. The standard shuttlecock can be shortened by trimming the upper portion of the skirt and a dome nose portion is in place of a ball.

Figure 5:
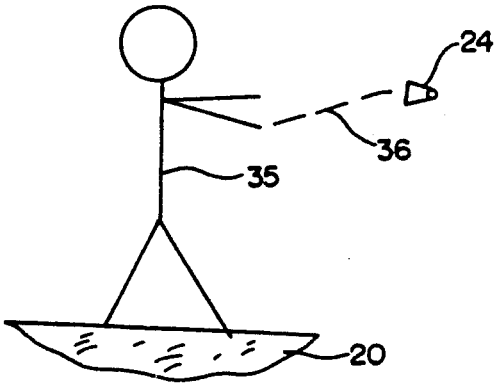
FIG. 5 is a side elevation of a player making the projectile toss toward the target of FIG. 6.

FIG. 5 depicts a game player 35 releasing by an underhand throw a palm held projectile. A trajectory path 36 is shown as hand held projectile 24 is propelled toward game target 10. As noted above the projectile is shorter than a standard badminton shuttlecock in order to fit in the players palm. Also the projectile is heavier in order to have proper flight characteristics from being propelled by hand.

Figure 6:
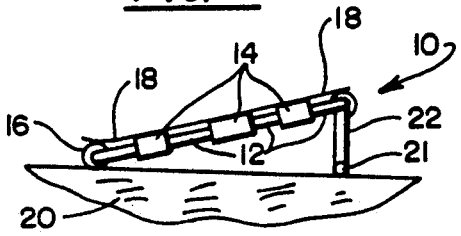
FIG. 6 is a side elevation of the target shown in FIG. 1.

FIG. 6 shows the game target in side elevation view. The parts are described above. This view shows the incline of game target 10 and the frustoconical shape of game projectile 24. This relationship provides the grab and capturing effect when the projectile lands on the landing surface 18. FIG. 6 depicts the incline of the target with an opposing incline of frustoconical game projectile 24. The inclined plane of landing surface 18 and the corresponding angle of incidence of the projectile provides the drag needed to provide the capture effect of my invention.

Operation

FIG. 5 and FIG. 6 depict the basic method of use for my invention. One player may use the game apparatus to hone their skills and for exercise. Two or four players can use the game apparatus for a horsehoe type sport event. Two game targets would likely be used. Any number can play the Horse Game previously described. Many other games can be thought of using the apparatus. In large open areas a course type sporting event can be played by spacing the game target in a course similar to golf but shorter in length. As in golf the low score wins. The game apparatus can be used for "hole" in one contests.

The game apparatus can be used indoors when there is ample room as in a garage. The game can be played by almost any age and mixed age groups provide a family fun activity.

From the foregoing it can be seen that the game apparatus provides for a number of games to be enjoyed by almost any age group. Said games can be played in sites that are prohibitive for other games such as beach areas. Enjoyment is enhanced by the ability of the game target to capture the projectile when it lands squarely on the target. Fun is also aided by the bounce of the projectile which is erratic if landing first on the ground and bouncing up and on to the target. This tends to level the skill required and gives young participants an even chance against adults.

It is apparent from the previous disclosures that various features and shapes can be modified from the preferred embodiment to those skilled in the art without deviation from the scope or spirit of the invention as defined by the following claims.

I claim:

1. A projectile toss game apparatus comprising a generally circular shaped landing surface of perforate thermoplastic fabric being ultra violet resistant, rot and mildew resistant, vinyl covered polyester, a circular formed tube of extruded polyethylene generally conforming to the outer circumference of said landing surface, said circular formed tube being held generally circular end to end by connector means, a plurality of tube sections of extruded flexible poly vinyl chloride tube, said tube sections being insertably positioned incurvate to said circular formed tube, whereby said tube sections are rotateable having a moderate friction fit on said circular formed tube, said tube sections being the substrate for bonding to said landing surface, whereby a cushion action is provided to said landing surface by the rotational give of said tube sections, a pivot arm support rotateably affixed to said connector means being positioned between ends of said circular formed tube, said pivot arm support extended from the pivot point to ground playing surface being generally vertical to said ground playing surface whereby the game target is held positioned on and angular to said ground playing surface said pivot arm rotateable to a position generally parallel to said landing surface for handling and storage, a horizontal arm support extending outwardly from lower end of said pivot arm support, whereby said horizontal arm support provides lateral support to said landing surface, in position to receive generally frusto conical shaped palm held projectiles launched by hand at said landing surface, said projectiles comprising a hollow conical frustum, a generally round, resiliant nose section of an organic compound affixed to the smaller end of said frustum, said projectile sized shorter and heavier than a standard badminton shuttlecock, being nominally 2" in length and 1 oz. weight with weight distribution providing a generally level flight pattern as said projectile is tossed at said game target.

2. A projectile toss game apparatus comprising, in combination:

a. A generally circular shaped landing surface of perforate thermoplastic fabric, b. An extruded tube of thermoplastic curved to generally conform to the outer circumference of said landing surface, c. A connector means joining the ends of said extruded tube thereby holding said tube generally configured as a circular formed tube, d. A plurality of thermoplastic tube sections generally larger in diameter and more flexible than said circular formed tube, being insertably positioned incurvate to said circular formed tube whereby said tube sections are rotateable having a moderate friction fit on said circular formed tube, e. Said tube sections being the substrate for bonding to said landing surface whereby a cushion action is provided to said landing surface by the rotational give of said tube sections, f. A pivot arm support being a rigid structural member pivotably positioned on said connector means between said circular formed tube ends holding the landing surface and tube assembly a predetermined distance off the ground playing surface with the 180 degree opposing point of said landing surface and tube assembly circumference resting on said ground playing surface, g. A horizontal arm support extending outwardly from lower end of said pivot arm support, whereby said horizontal arm support provides lateral support to said landing surface, h. A projectile of generally frusto conical shape and sized whereby said projectile comfortably fits in the palm of an adult players hand, yet playable also by young children, with a generally round, resilient nose section of a flexible organic compound affixed to the small end of said frusto conical projectile, said palm held projectile being generally heavier than a standard badminton shuttlecock with weight added near said nose of said projectile to provide for a generally low arc flight pattern to allow said frusto conical shape of said projectile, landing with maximum contact of said game target set in an acclivitous position thereby minimizing rebound off said game target.

3. A structure of claim 2 wherein said circular shaped landing surface is of polypropylene mesh fabric.

4. A structure of claim 2 wherein said circular formed tube is extruded polypropylene.

5. A structure of claim 2 wherein the connector means joining ends of said circular formed tube is a dowel inserted into the inner diameter of said circular formed tube.

6. A structure of claim 2 wherein the connector means joining ends of said circular formed tube is a sleeve positioned on the outer diameter of said circular formed tube.

7. A structure of claim 2 wherein is added a bottom tube section of rigid thermo plastic tubing positioned loosely on said circular formed tube at ground level holding the lower segment of said landing surface in reverse acclivity sufficient to minimize roll back of the landed projectile.

* * * * *